US005350730A

United States Patent [19]

Hirota et al.

[11] Patent Number: 5,350,730

[45] Date of Patent: Sep. 27, 1994

[54] IMAGE-RECEIVING SHEET FOR THERMAL TRANSFER RECORDING

[75] Inventors: Takao Hirota, Machida; Katsuhiko Kuroda, Yokohama; Mamika Tamaki, Machida, all of Japan

[73] Assignee: Mitsubishi Kasei Corporation, Tokyo, Japan

[21] Appl. No.: 868,655

[22] Filed: Apr. 15, 1992

[30] Foreign Application Priority Data

Apr. 19, 1991 [JP] Japan ..... 3-116814
Apr. 19, 1991 [JP] Japan ..... 3-116815
Apr. 19, 1991 [JP] Japan ..... 3-116816

[51] Int. Cl.[5] ..... B41M 5/035; B41M 5/38

[52] U.S. Cl. ..... 503/227; 428/195; 428/412; 428/480; 428/500; 428/913; 428/914

[58] Field of Search ..... 8/471; 428/195, 913, 428/914; 503/227

[56] References Cited

U.S. PATENT DOCUMENTS 4,902,669 2/1990 Matsuda et al. ..... 503/227
5,073,533 12/1991 Aono ..... 503/227

FOREIGN PATENT DOCUMENTS 0257633 3/1988 European Pat. Off. .
60-19138 1/1985 Japan .
61-274990 12/1986 Japan .
280291 3/1990 Japan .

*Primary Examiner*—B. Hamilton Hess
*Attorney, Agent, or Firm*—Oblon, Spivak, McClelland, Maier & Neustadt

[57] ABSTRACT

Disclosed herein is an image receiving sheet for dye transfer-type thermal transfer recording, comprising:

a substrate, and an image receiving layer formed on the surface of said substrate, and composed of a resin having dyeing property and an aliphatic ester having 24 or more carbon atoms per one ester group, a hydrocarbon oil, a fatty acid ester of a polyhydric alcohol or a mixture thereof.

16 Claims, 1 Drawing Sheet

IMAGE-RECEIVING SHEET FOR THERMAL TRANSFER RECORDING

BACKGROUND OF THE INVENTION

The present invention relates to an image-receiving sheet for dye transfer-type thermal transfer recording.

Dye transfer-type thermal transfer recording is a recording system in which a color sheet for transfer recording is heated by a heating means such as thermal head to transfer the dye onto an image receiving sheet for transfer recording. The color sheet comprises a base sheet and a coloring layer disposed on one side thereof, and composed of a vaporable or thermally diffusible dye and a binder resin. The image receiving sheet comprises a substrate, and an image receiving layer containing a resin having dyeing property and formed on the surface thereof.

In the said dye transfer-type thermal transfer recording, the image receiving layer of the image-receiving sheet is demanded to satisfy the following performance requirements:

(1) The color sheet won't be fused to the image-receiving layer during the transfer recording operations and can be easily separated after recording, and there can be obtained record with excellent gradation.

(2) The image receiving layer has good dyeing property and is capable of high-density recording.

(3) The storage stability such as light resistance, darkening and fading resistance, bleeding resistance, migrating resistance, etc., of the records are excellent.

For satisfying these performance requirements for image receiving sheet, preparation and selection of the resin and adjuncts forming the image receiving layer are important. But it is difficult with the conventional preparation and selection techniques to obtain an image receiving sheet with satisfactory quality and performance.

In order to attain an enhancement of recording sensitivity and density in the conventional thermal transfer recording method, it is necessary to improve the dye diffusion characteristics of the image receiving layer of the image receiving sheet so as to facilitate a transfer of the dye and to minimize the risk blotting of the image, shading-off of the image or back-transfer (which is a phenomenon that the once transferred dye is brought back to the color sheet on the occasion of lapping-transfer of the next dye).

For this purpose, it is practiced in the art to add an additive having an action to lower the glass transition point (Tg) of the polymeric material of the image receiving layer to an appropriate level.

As the additive to be added to the image-receiving layer, there are known a phthalic acid ester as a plasticizer (for example, Japanese Patent Application Laid-Open (KOKAI) Nos. 274990/86, 19138/85 and 80291/90). This plasticizer, however, is too active and tend to induce excessive diffusion of the dye during storage of the image, to deteriorate a blotting resistance and a migrating property of the image, and to cause shading-off of the image or back-transfer, thereby making it unable to obtain the well-balanced image qualities of the image receiving layer.

Thus, an offer of a high-quality image receiving layer which can meet both requirements for storage stability and dyeing property, that is, which is improved in dyeing property without impairing the storage stability of the image and capable of high-density recording, is demanded.

As a result of strenuous studies on the subject matter, it has been found that an image receiving sheet for thermal transfer recording obtained by incorporating an aliphatic ester having 24 or more carbon atoms per one ester group, a hydrocarbon oil, a fatty acid ester of a polyhydric alcohol or a mixture thereof in an image receiving layer composed of a resin having dyeing property and formed on a substrate surface, has an excellent dyeing property and is capable of high-density recording and excellent in storage stability. The present invention has been achieved on the basis of this finding.

SUMMARY OF THE INVENTION

In an aspect of the present invention, there is provided an image receiving sheet for dye transfer-type thermal transfer recording, comprising:

a substrate, and an image receiving layer formed on the surface of the said substrate, and composed of a resin having dyeing property and an aliphatic ester having 24 or more carbon atoms per one ester group, a hydrocarbon oil, a fatty acid ester of a polyhydric alcohol or a mixture thereof.

DESCRIPTION OF THE PREFERRED EMBODIMENT

Figure 1:
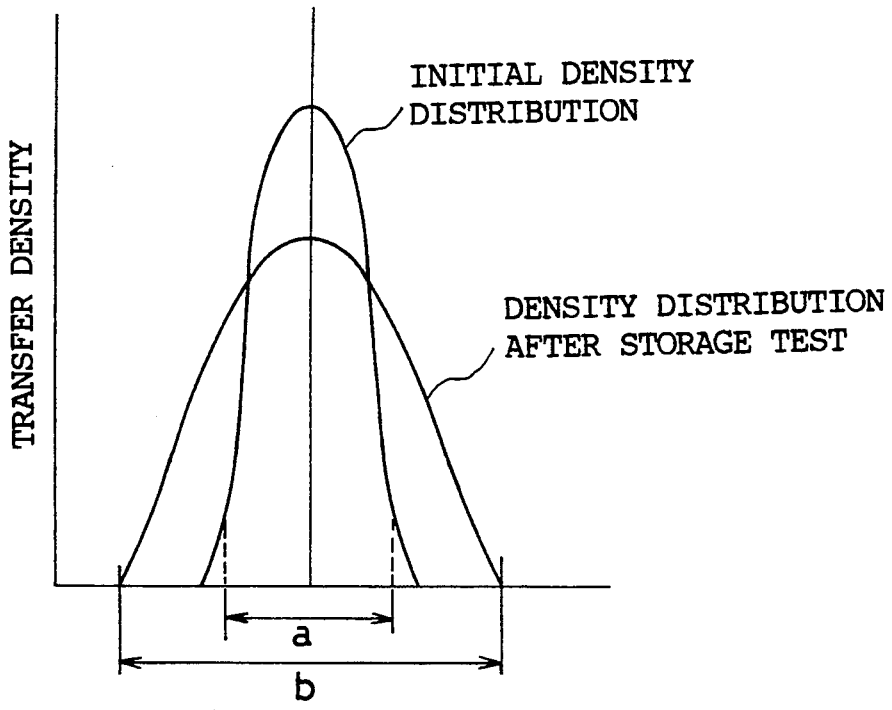
FIG. 1 is a graph showing the density distribution curves of a transfer image of one dot, wherein the length of one dot is plotted as abscissa and the transfer density as ordinate.

The image receiving sheet for thermal transfer recording according to the present invention comprises an image receiving layer composed on the said specific compound of the present invention and a resin having a dyeing property, and formed on the surface of a substrate.

As the resins having the dyeing property (dyeing affinity) usable for the image receiving layer according to the present invention, saturated polyester, acrylic resin, methacrylic resin, styrene resin, polycarbonate, cellulose acetate, polyvinyl acetal, polyvinyl phenylacetal, vinyl chloride resin, vinyl chloride-vinyl acetate copolymer, polyarylate, AS resin and the crosslinked versions of the said resins may be exemplified. These resins have excellent dyeing property for the vaporable or thermally diffusible dyes. As the substrate, there can be used the commonly employed base materials such as synthetic paper, cellulose paper and the like.

The "aliphatic ester having 24 or more carbon atoms per one ester group" used for the image receiving layer according to the present invention is an ester in which both of its alcohol component and acid component are aliphatic. In the present invention, there is used an aliphatic ester having 24 or more, preferably 24 to 50, more preferably 26 to 50, most preferably 28 to 50 carbon atoms per one ester group (—COO—). It is especially preferred to use an aliphatic ester consisting of an aliphatic alcohol of 8 or more, preferably 12 to 32 carbon atoms, and a fatty acid of 8 or more, preferably 12 to 32 carbon atoms.

As the aliphatic alcohols having 8 or more carbon atoms usable in the present invention, aliphatic alcohols in which straight-chain hydrocarbons are substituted with hydroxyl group, such as n-octyl alcohol, 2-ethylhexyl alcohol, n-decyl alcohol, i-decyl alcohol, lauryl alcohol, i-tridecyl alcohol, myristyl alcohol, cetyl alcohol, stearyl alcohol, oleyl alcohol and behenyl alcohol, and aliphatic alcohols in which branched hydrocarbons are substituted with hydroxyl group, such as hexyldecyl alcohol, isostearyl alcohol and octyldodecyl alcohol may be exemplified.

As the aliphatic acids having 8 or more carbon atoms usable in the present invention, the saturate and unsaturated aliphatic acids such as caprylic acid, capric acid, lauric acid, myristic acid, palmitic acid, stearic acid, oleic acid, behenic acid and 2-ethylhexanoic acid may be exemplified.

As the hydrocarbon oil, there can be used in the present invention those hydrocarbon oils which are fluid at normal temperature, such as aromatic process oils, naphthenic process oils, parrafinic process oils, liquid parrafin and synthetic hydrocarbon-type lubricant oils.

The "fatty acid esters of polyhydric alcohols" referred to the present invention are the esters of polyhydric alcohols and fatty acids. As the polyhydric alcohols usable in the present invention, the aliphatic polyhydric alcohols such as glycerin, sorbitol, sucrose, alkylene glycol and polyalkylene glycol may be exemplified. As the fatty acids usable in the present invention, caprylic acid, capric acid, lauric acid, myristic acid, palmitic acid, stearic acid, oleic acid and behenic acid may be exemplified.

The content of the said aliphatic ester having 24 or more carbon atoms per one ester group, the said hydrocarbon oil, the said fatty acid ester of a polyhydric alcohol or the mixture thereof in the image receiving layer is preferably in the range of 2 to 50% by weight, preferably 10 to 30% by weight based on the resin having dyeing property. Also, in the image receiving layer according to the present invention, a lubricant and/or various kinds of stabilizer may be contained in the resin having dyeing property. The said aliphatic ester having 24 or more carbon atoms per one ester group, the said hydrocarbon oil and the said fatty acid ester of polyhydric alcohol can be used either singly or as a mixture of two or more of them.

The image receiving sheet for thermal transfer recording according to the present invention can be obtained by preparing a coating solution containing the resin having dyeing property, and the aliphatic ester having 24 or more carbon atoms per one ester group, the hydrocarbon oil, the fatty acid ester of a polyhydric alcohol or the mixture thereof by using an appropriate solvent such as toluene and methyl ethyl ketone, and applying the thus-obtained coating solution on the substrate and drying the resultant coating to form an image receiving layer. The thickness of the image receiving layer (the coat thickness after dried) is usually in the range of 0.1 to 20 μm, preferably 1 to 10 μm.

As for the coating method, any appropriate method may be selected from among the ordinary methods using a suitable coater such as reverse roll coater, gravure coater, rod coater, air doctor coater and die coater. For details of these coating methods, refer to Yuji HARASAKI, Coating Systems (published in 1977 by Maki Shoten).

For the color sheet for thermal transfer recording which is jointly used with the image receiving sheet of the present invention, a variety of nonionic dyes such as azo dyes, anthraquinone dyes, nitro dyes, styryl dyes, naphthoquinone dyes, quinophthalone dyes, azomethine dyes, cumarin dyes and condensed polycyclic dyes can be used as the vaporable or thermally diffusive dye.

EXAMPLES

The present invention will hereinafter be described in further detail by showing the examples thereof. It is to be understood, however, that these examples are merely intended to be illustrative and not to be construed as limiting the scope of the invention.

In the following Examples, all "parts" are "part by weight".

Example 1—1

(a) Preparation of image receiving sheet

First, a coating solution was prepared by dissolving 10 parts of polyvinyl phenylacetal represented by the following formula in a mixed solvent of 15 parts of methyl ethyl ketone and 15 parts of toluene and adding in the resulting solution 1.5 parts of octyldodecyl myristate having 34 carbon atoms per one ester group (Excepearl OD-M, produced by Kao Co., Ltd.) and 0.5 parts of amino-modified silicone (KF-393, produced by Shin-Etsu Chemical Industries Co., Ltd.).

The coating solution thus prepared was applied on a polypropylene synthetic paper (150 μm in thickness) by a wire bar and dried the resultant coating to form an image receiving layer having a dry film thickness of about 5 μm, thereby obtaining an image receiving sheet.

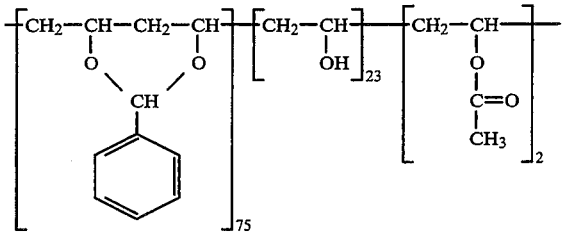

(b) Preparation of color sheet

An ink composed of 5 parts of a magenta dye represented by the following formula, 10 parts of polycarbonate and 85 parts of toluene was applied on one side of a biaxially stretched polyethylene terephthalate film (4.5 μm in thickness) which had been subjected to heat resistance and lubrication treatments and the applied ink was dried to form a coloring layer having a dry film thickness of about 1 μm, thereby obtaining a color sheet.

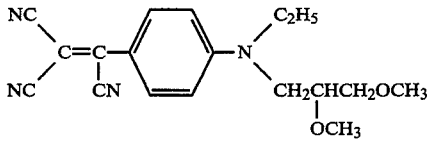

(c) Transfer recording test and storage stability test of records (i) Transfer recording test The ink applied side of the said color sheet was placed on the image receiving layer side of the said image receiving sheet, and recording was carried out by using a partially glazed thermal line head having a resistance heating element density of 6 dot/mm under the following conditions. Transfer density of the obtained records was measured, the results being shown in Table 1.

Recording line density: 6 line/mm
Power applied to thermal head: 0.30 W
Pulse width applied to thermal head: 6 msec (ii) Storage stability of records The records were kept in storage under the conditions of 60° C. and 60% RH for 7 days, and the degree of dye bleeding of the records after the said storage was determined by a micro-densitometer (PDM-5, produced by Sakura Co., Ltd.). The results are shown in Table 1.

The numerical values of bleeding in the table indicate the increase ratio (b/a) of the base length of the density distribution curves of one dot transfer image shown in FIG. 1. The smaller the numerical value, the better is the record storage stability.

Example 1-2

An image receiving sheet and a color sheet were made in the same process as Example 1—1 except that a yellow dye represented by the following formula was used instead of the dye used in Example 1—1 (b), and the tests were conducted as in Example 1—1. The results are shown in Table 1.

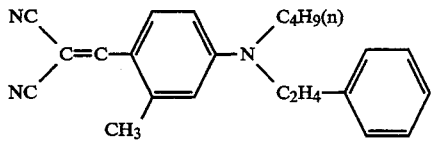

Example 1-3

An image receiving sheet and a color sheet were made in the same way as Example 1—1 except that a cyan dye represented by the following formula was used instead of the dye used in Example 1—1 (b), and the tests were conducted as in Example 1—1. The results are shown in Table 1.

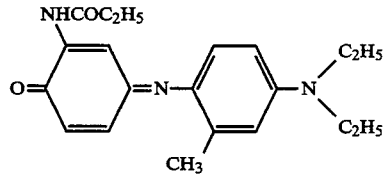

Examples 1-4 to 1-9

Image receiving sheets and color sheets were made in the same way as Examples 1—1 to 1-3 except that 2-ethylhexyl behenoate having 30 carbon atoms per one ester group (Examples 1-4, 1-5 and 1-6) or behenyl 2-ethylhexanoate having 30 carbon atoms per one ester group (Examples 1-7, 1-8 and 1-9) was used for the image-receiving layer instead of octyldodecyl myristate used in Examples 1—1 to 1-3, and the tests were conducted as in Example 1—1. The results are shown in Table 1.

Examples 1-10 to 1-12

Image receiving sheets and color sheets were made in the same way as Examples 1—1 to 1-3 except that a saturated polyester (Vylon-290, produced by Toyobo Co., Ltd.) was used for the image receiving layer instead of the polyvinyl phenylacetal used in Examples 1—1 to 1-3, and the tests were conducted according to Example 1—1. The results are shown in Table 1.

Comparative Examples 1—1 to 1-3

Image receiving sheets and color sheets were made in the same way as Examples 1—1 to 1-3 except that no octyldodecyl myristate was used for the image receiving layer, and the tests were conducted as in Example 1—1. The results are shown in Table 1.

Comparative Examples 1-4 to 1-12

Image receiving sheets and color sheets were made in the same way as Examples 1—1 to 1-3 except that isopropyl myristate having 17 carbon atoms per one ester group (Comparative Examples 1-4, 1-5 and 1-6), dimethyl phthalate (aromatic ester) (Comparative Examples 1-7, 1-8 and 1-9), or dioctyl phthalate (aromatic ester) (Comparative Examples 1-10, 1-11 and 1-12) was used for the image receiving layer instead of octyldodecyl myristate used in Examples 1—1 to 1-3, and the tests were conducted in accordance with Example 1—1. The results are shown in Table 1.

In the table, "A" denotes polyvinyl phenyl acetal and "B" denotes saturated polyester.

TABLE 1

| | Resin | Ester | Dye | Records: Transfer density | Records: Bleeding |
|---|---|---|---|---|---|
| Example 1-1 | A | Octyldodecyl myristate | Magenta | 2.13 | 1.0 |
| Example 1-4 | A | 2-ethylhexyl behenoate | Magenta | 2.10 | 1.1 |
| Example 1-7 | A | Behenyl 2-ethyl-hexaonate | Magenta | 2.05 | 1.1 |
| Comp. Ex. 1-1 | A | — | Magenta | 1.72 | 1.0 |
| Comp. Ex. 1-4 | A | Isoprophyl myristate | Magenta | 2.10 | 2.0 |
| Comp. Ex. 1-7 | A | Dimethyl phthalate | Magenta | 2.12 | 1.9 |
| Comp. Ex. 1-10 | A | Dioctyl phthalate | Magenta | 2.24 | 2.2 |
| Example 1-2 | A | Octyldodecyl myristate | Yellow | 2.04 | 1.0 |
| Example 1-5 | A | 2-ethylhexyl behenoate | Yellow | 1.99 | 1.0 |
| Example 1-8 | A | Behenyl 2-ethyl-hexanoate | Yellow | 1.96 | 1.2 |
| Comp. Ex. 1-2 | A | — | Yellow | 1.64 | 1.0 |
| Comp. Ex. 1-5 | A | Isoprophyl myristate | Yellow | 2.02 | 1.9 |
| Comp. Ex. 1-8 | A | Dimethyl phthalate | Yellow | 1.98 | 1.9 |
| Comp. Ex. 1-11 | A | Dioctyl phthalate | Yellow | 2.15 | 2.1 |
| Example 1-3 | A | Octyldodecyl myristate | Cyan | 1.96 | 1.0 |
| Example 1-6 | A | 2-ethylhexyl behenoate | Cyan | 1.88 | 1.1 |

TABLE 1-continued

| | Resin | Ester | Dye | Records: Transfer density | Records: Bleeding |
|---|---|---|---|---|---|
| Example 1-9 | A | Behenyl 2-ethylhexanoate | Cyan | 1.85 | 1.1 |
| Comp. Ex. 1-3 | A | — | Cyan | 1.62 | 1.0 |
| Comp. Ex. 1-6 | A | Isoprophyl myristate | Cyan | 1.89 | 2.2 |
| Comp. Ex. 1-9 | A | Dimethyl phthalate | Cyan | 1.97 | 2.0 |
| Comp. Ex. 1-12 | A | Dioctyl phthalate | Cyan | 2.04 | 2.3 |
| Example 1-10 | B | Octyldodecyl myristate | Magenta | 2.21 | 1.2 |
| Example 1-11 | B | Octyldodecyl myristate | Yellow | 2.11 | 1.2 |
| Example 1-12 | B | Octyldodecyl myristate | Cyan | 2.03 | 1.2 |

Examples 2-1 to 2-9

Image receiving sheets and color sheets were made in the same procedure as Examples 1—1 to 1-3 except that a process oil (SUNPAR OIL 150, Nippon Sun Petroleum Co., Ltd.), a liquid paraffin (WHITELEX 334, Mobile Petroleum Co., Ltd.) or a synthetic lubricant (MOBILE SHF-41, Mobile Petroleum Co., Ltd.) was used for the image receiving layer instead of octyldodecyl myristate, and the tests were conducted in accordance with Example 1—1. The results are shown in Table 2.

Examples 2-10 to 2-12

Image receiving sheets and color sheets were made in the same way as Examples 2-1 to 2-3 except that a saturated polyester (Vylon-290, Toyobo Co., Ltd.) was used for the image receiving layer instead of the polyvinyl phenylacetal used in Examples 2-1 to 2-3, and the tests were conducted as in Example 1—1. The results are shown in Table 2.

Comparative Examples 2-1 to 2-3

Image receiving sheets and color sheets were made in the same process as Examples 2-1 to 2-3 except that no process oil was used in forming the image-receiving layer, and the tests were conducted in accordance with Example 1—1. The results are shown in Table 2.

Comparative Examples 2-4 to 2-6

Image receiving sheets and a color sheets were made in the same process as Examples 2-10 to 2-12 except that no process oil was used in forming the image-receiving layer, and the tests were conducted in according to Example 1—1. The results are shown in Table 2.

In the table, "A" denotes polyvinyl phenylacetal and "B" denotes saturated polyester.

TABLE 2

| | Resin | Ester | Dye | Records: Transfer density | Records: Bleeding |
|---|---|---|---|---|---|
| Example 2-1 | A | Process oil | Magenta | 2.10 | 1.0 |
| Example 2-4 | A | Liquid paraffin | Magenta | 2.08 | 1.1 |
| Example 2-7 | A | Synthetic lubricant | Magenta | 2.01 | 1.1 |

TABLE 2-continued

| | Resin | Ester | Dye | Records: Transfer density | Records: Bleeding |
|---|---|---|---|---|---|
| Comp. Ex. 2-1 | A | — | Magenta | 1.72 | 1.0 |
| Example 2-10 | B | Process oil | Magenta | 2.15 | 1.2 |
| Comp. Ex. 2-4 | B | — | Magenta | 2.00 | 1.2 |
| Example 2-2 | A | Process oil | Yellow | 1.96 | 1.0 |
| Example 2-5 | A | Liquid paraffin | Yellow | 1.90 | 1.0 |
| Example 2-8 | A | Synthetic lubricant | Yellow | 1.93 | 1.2 |
| Comp. Ex. 2-2 | A | — | Yellow | 1.64 | 1.0 |
| Example 2-11 | B | Process oil | Yellow | 2.09 | 1.2 |
| Comp. Ex. 2-5 | B | — | Yellow | 1.95 | 1.1 |
| Example 2-3 | A | Process oil | Cyan | 1.92 | 1.0 |
| Example 2-6 | A | Liquid paraffin | Cyan | 1.84 | 1.1 |
| Example 2-9 | A | Synthetic lubricant | Cyan | 1.82 | 1.1 |
| Comp. Ex. 2-3 | A | — | Cyan | 1.62 | 1.0 |
| Example 2-12 | B | Process oil | Cyan | 2.00 | 1.2 |
| Comp. Ex. 2-6 | B | — | Cyan | 1.83 | 1.2 |

Examples 3-1 to 3-9

Image receiving sheets and color sheets were made in the same procedure as Examples 1—1 to 1-3 except that behenic acid monoglyceride (Excepearl G-MB, Kao Co., Ltd.), oleic acid monoglyceride (Excel O-95R, Kao Co., Ltd.) or sorbitan monolaurate (Leodol super SP-S10) was used instead of octyldodecyl myristate in forming the image receiving layer, and the tests were performed in accordance with Example 1—1. The results are shown in Table 3.

Examples 3-10 to 3-12

Image receiving sheets and color sheets were made in the same way as Examples 3-1 to 3—3 except that a saturated polyester (Vylon -290, Toyoho Co., Ltd.) was used instead of the polyvinyl phenylacetal resin in forming the image receiving layer, and the tests were conducted in accordance with Example 1—1. The results are shown in Table 3.

Comparative Examples 3-1 to 3—3

Image receiving sheets and color sheets were made in the same process Examples 3-1 to 3—3 except that no behenic acid monoglyceride was used in forming the image receiving layer, and the tests were carried out as in Example 1—1. The results are shown in Table 3.

Comparative Examples 3-4 to 3-6

Image receiving sheets and color sheets were made by following the same process Examples 3-10 to 3-12 except that no behenic acid monoglyceride was used in forming the image receiving layer, and the tests were conducted in accordance with Example 1—1. The results are shown in Table 3.

In the table, "A" denotes polyvinyl phenylacetal and "B" denotes saturated polyester.

TABLE 3

| | Resin | Ester | Dye | Records: Transfer density | Records: Bleeding |
|---|---|---|---|---|---|
| Example 3-1 | A | Behenic acid monoglyceride | Magenta | 2.15 | 1.0 |
| Example 3-4 | A | Oleic acid monoglyceride | Magenta | 2.11 | 1.1 |
| Example 3-7 | A | Sorbitan monolaurate | Magenta | 2.06 | 1.1 |
| Comp. Ex. 3-1 | A | — | Magenta | 1.72 | 1.0 |
| Example 3-10 | B | Behenic acid monoglyceride | Magenta | 2.21 | 1.2 |
| Comp. Ex. 3-4 | B | — | Magenta | 2.00 | 1.2 |
| Example 3-2 | A | Behenic acid monoglyceride | Yellow | 2.02 | 1.0 |
| Example 3-5 | A | Oleic acid monoglyceride | Yellow | 1.96 | 1.0 |
| Example 3-8 | A | Sorbitan monolaurate | Yellow | 1.98 | 1.2 |
| Comp. Ex. 3-2 | A | — | Yellow | 1.64 | 1.0 |
| Example 3-11 | B | Behenic acid monoglyceride | Yellow | 2.13 | 1.2 |
| Comp. Ex. 3-5 | B | — | Yellow | 1.95 | 1.1 |
| Example 3-3 | A | Behenic acid monoglyceride | Cyan | 1.98 | 1.0 |
| Example 3-6 | A | Oleic acid monoglyceride | Cyan | 1.88 | 1.1 |
| Example 3-9 | A | Sorbitan monolaurate | Cyan | 1.87 | 1.1 |
| Comp. Ex. 3-3 | A | — | Cyan | 1.62 | 1.0 |
| Example 3-12 | B | Behenic acid monoglyceride | Cyan | 2.11 | 1.2 |
| Comp. Ex. 3-6 | B | — | Cyan | 1.83 | 1.2 |

What is claimed is:

1. An image receiving sheet for dye transfer-type thermal transfer recording, comprising:

a substrate, and an image receiving layer formed on the surface of said substrate, and composed of a resin having dyeing property and an aliphatic ester having 24 or more carbon atoms per one ester group, a fatty acid ester of a polyhydric alcohol or a mixture thereof.

2. An image receiving sheet according to claim 1, wherein the aliphatic ester having 24 or more carbon atoms per one ester group is an ester of an aliphatic alcohol having 8 or more carbon atoms and a fatty acid having 8 or more carbon atoms.

3. An image receiving sheet according to claim 1, wherein the aliphatic ester having 24 or more carbon atoms per one ester group is an ester of an aliphatic alcohol selected from the group consisting of n-octyl alcohol, 2-ethylhexyl alcohol, n-decyl alcohol, i-decyl alcohol, lauryl alcohol, i-tridecyl alcohol, myristyl alcohol, cetyl alcohol, stearyl alcohol, oleyl alcohol, behenyl alcohol, hexyldecyl alcohol, isostearyl alcohol and octyldodecyl alcohol, and an aliphatic acid selected from the group consisting of 2-ethylhexanoic acid, caprylic acid, capric acid, lauric acid, myristic acid, palmitic acid, stearic acid, oleic acid and behenic acid.

4. An image receiving sheet according to claim 3, wherein the aliphatic ester having 24 or more carbon atoms per one ester group is octyldodecyl myristate, 2-ethylhexyl behenoate or behenyl 2-ethylhexanoate.

5. An image receiving sheet according to claim 1, wherein the fatty acid ester of a polyhydric alcohol is an ester of a polyhydric alcohol selected from the group consisting of glycerin, sorbitol, sucrose, alkylene glycol and polyalkylene glycol, and a fatty acid selected from the group consisting of caprylic acid, capric acid, lauric acid, myristic acid, palmitic acid, stearic acid, oleic acid and behenic acid.

6. An image receiving sheet according to claim 5, wherein the fatty acid ester of a polyhydric alcohol is behenic acid monoglyceride, oleic acid monoglyceride or sorbitan monolaurate.

7. An image receiving sheet according to claim 1, wherein the content of the aliphatic ester having 24 or more carbon atoms per one ester group, the fatty acid ester of a polyhydric alcohol or the mixture thereof is 2 to 50% by weight based on the resin having dyeing property.

8. An image receiving sheet according to claim 1, wherein the resin having dyeing property is a saturated polyester, acrylic resin, methacrylic resin, styrene resin, polycarbonate, cellulose acetate, polyvinyl acetal resin, polyvinyl phenylacetal, vinyl chloride resin, vinyl chloride-vinyl acetate copolymer, polyarylate or AS resin or a crosslinked resin thereof.

9. An image receiving sheet according to claim 1, wherein the thickness of the image receiving layer is 0.1 to 20 μm.

10. An image receiving sheet for dye transfer-type thermal transfer recording, comprising:

a substrate, and an image receiving layer formed on the surface of said substrate, and composed of a resin having dyeing property and an aliphatic ester having 24 or more carbon atoms per one ester group.

11. The image receiving sheet according to claim 10, wherein said aliphatic ester having 24 or more carbon atoms per one ester group is an ester of an aliphatic alcohol having 8 or more carbon atoms and a fatty acid having 8 or more carbon atoms.

12. The image receiving sheet according to claim 10, wherein said aliphatic ester having 24 or more carbon atoms per one ester group is an ester of an aliphatic alcohol selected from the group consisting of n-octyl alcohol, 2-ethylhexyl alcohol, n-decyl alcohol, i-decyl alcohol, lauryl alcohol, i-tridecyl alcohol, myristyl alcohol, cetyl alcohol, stearyl alcohol, oleyl alcohol, behenyl alcohol, hexyldecyl alcohol, isostearyl alcohol, octyldodecyl alcohol and a mixture thereof and an aliphatic acid selected from the group consisting of 2-ethylhexanoic acid, caprylic acid, capric acid, lauric acid, myristic acid, palmitic acid, stearic acid, oleic acid, benhenic acid and a mixture thereof.

13. The image receiving sheet according to claim 12, wherein said aliphatic ester having 24 or more carbon atoms per one ester group is selected from the group consisting of octyldodecyl myristate, 2-ethylhexyl behenoate, behenyl 2-ethylhexanoate and a mixture thereof.

14. The image receiving sheet according to claim 10, wherein the content of said aliphatic ester having 24 or more carbon atoms per one ester group is 2 to 50% by weight based on said resin having dyeing property.

15. The image receiving sheet according to claim 10, wherein said resin having dyeing property is selected from the group consisting of a saturated polyester, acrylic resin, methacrylic resin, styrene resin, polycarbonate, cellulose acetate, polyvinyl acetal resin, polyvinyl phenylacetal, vinyl chloride resin, vinyl chloride-vinyl acetate copolymer, polyarylate or AS resin or a crosslinked resin thereof.

16. The image receiving sheet according to claim 10, wherein the thickness of said image receiving layer is 0.1 to 20 μm.

* * * * *